US006839448B2

(12) United States Patent
Chen

(10) Patent No.: US 6,839,448 B2
(45) Date of Patent: Jan. 4, 2005

(54) EARPIECE HAVING DETACHABLE BATTERY DEVICE

(75) Inventor: I Tao Chen, Chong Ho (TW)

(73) Assignee: Global Sun Technology Inc., Taipei (TW)

( * ) Notice: Subject to any disclaimer, the term of this patent is extended or adjusted under 35 U.S.C. 154(b) by 117 days.

(21) Appl. No.: 10/404,594

(22) Filed: Mar. 29, 2003

(65) Prior Publication Data

US 2004/0190743 A1 Sep. 30, 2004

(51) Int. Cl.[7] ..... H04R 25/00

(52) U.S. Cl. ..... 381/370; 381/374; 381/381; 381/384

(58) Field of Search ..... 381/323, 327, 381/328, 330, 370, 374, 379, 380, 381, 383, 384; 379/430; 429/100; 181/128–130, 135

(56) References Cited

U.S. PATENT DOCUMENTS 4,893,344 A * 1/1990 Tragardh et al. ..... 381/381
5,655,026 A * 8/1997 Peters et al. ..... 381/385
5,761,298 A * 6/1998 Davis et al. ..... 379/430
5,960,094 A * 9/1999 Jensen et al. ..... 381/381

* cited by examiner

*Primary Examiner*—Huyen D. Le

(57) ABSTRACT

An earpiece includes a housing, an arm having one or more projections extended from one end and rotatably engaged into the housing, and an arc having one end rotatably secured to the arm and rotatable relative to the arm. The arc includes a chamber, a casing is received in the chamber of the arc, and has a space to receive one or more batteries. A cap is engaged onto the casing, to retain the battery in the casing. The casing includes a latch detachably secured to the arc, to detachably secure the casing and the battery and the cap to the arc.

10 Claims, 6 Drawing Sheets

EARPIECE HAVING DETACHABLE BATTERY DEVICE

BACKGROUND OF THE INVENTION

1. Field of the Invention

The present invention relates to an earpiece, and more particularly to an earpiece having a battery device that may be easily disengaged or detached from the earpiece for charging purposes.

2. Description of the Prior Art

Typical earpieces are provided for attaching onto ears of users, and comprise a hanger member for engaging onto or for attaching onto the ears of the users, and one or more batteries received in the hanger member for supplying the electric energy to the earpiece.

However, the batteries are solidly attached and received in the hanger member, and may not be disengaged from the hanger member.

When the batteries are short of electric energy, and are required to be charged, the hanger members of the typical earpieces should be disengaged from the ears of the users, and are then required to be coupled to the electric power source for charging purposes.

The typical earpieces may be used again only after the batteries have been fully charged with the electric energy.

The present invention has arisen to mitigate and/or obviate the afore-described disadvantages of the conventional earpieces.

SUMMARY OF THE INVENTION

The primary objective of the present invention is to provide an earpiece including a battery device that may be easily disengaged or detached from the earpiece for charging purposes.

In accordance with one aspect of the invention, there is provided an earpiece comprising a housing, an arm including a first end having at least one projection extended therefrom and rotatably engaged into the housing, and the arm including a second end, an arc including a first end rotatably secured to the second end of the arm, and rotatable relative to the arm, and the arc including a chamber formed therein, a casing received in the chamber of the arc, and including a space formed therein, a battery received in the space of the casing, and a cap engaged onto the casing, to retain the battery in the casing. The casing includes a latch detachably secured to the arc, to detachably secure the casing and the battery and the cap to the arc. The battery may be easily removed from the arc of the earpiece, and may be charged while separated from the earpiece. Another battery may be attached onto the earpiece, to energize the earpiece, such that the users are not required to wait until the earpiece is fully charged.

The housing includes a recess formed in the rear portion thereof, to rotatably receive the first end of the arm. The first end of the arm includes a ball provided therein, and having the projection extended from the ball.

The arc includes at least one peripheral groove formed in the first end thereof, and the arm includes at least one peripheral swelling extended therefrom and engaged into the peripheral groove of the arc, to rotatably secure the arm to the arc.

The housing includes a cover attached thereon and having at least one orifice formed therein, the housing further includes a circuit board disposed in the housing, and having at least one button disposed thereon and extended through the orifice of the cover.

The casing includes a hole formed therein, the battery includes a socket provided thereon and aligned with the hole of the casing. A charging device may further be provided and includes a plug engaged through the hole of the casing and coupled to the socket of the battery.

The arc includes a pivotal lid attached thereto to enclose the hole of the casing. The cap includes an aperture formed therein, the battery includes a light member attached thereto and engaged through the aperture of the cap. The cap includes an opening formed therein, the arc includes a pivotal lid attached thereto to enclose the opening of the cap.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
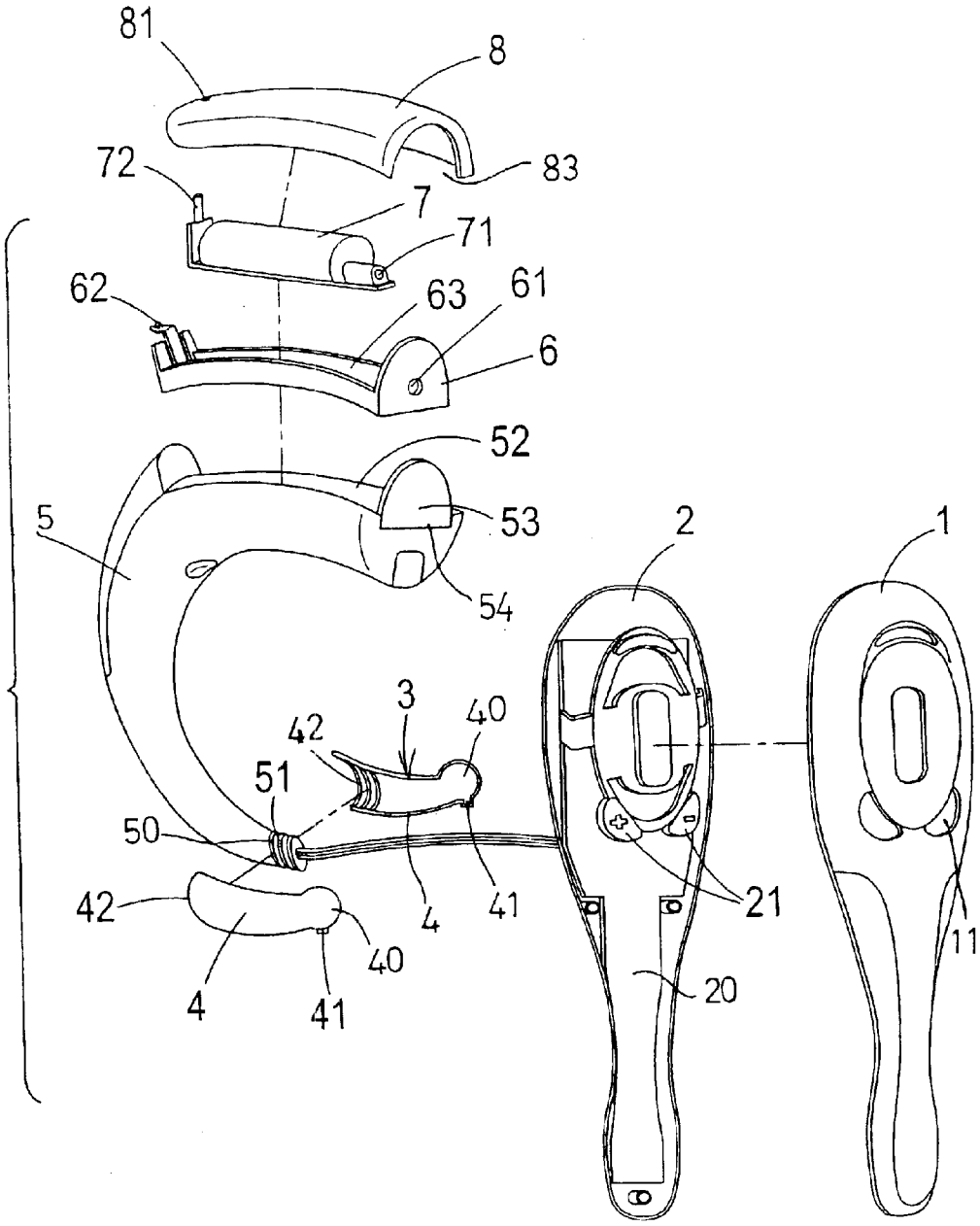
FIG. 1 is an exploded view of an earpiece in accordance with the present invention.

Referring to the drawings, and initially to FIGS. 1–6, an earpiece 1 in accordance with the present invention comprises a housing 2, and a cover 1 attached and secured onto the housing 2 with such as fasteners (not shown) or the like.

Figure 3:
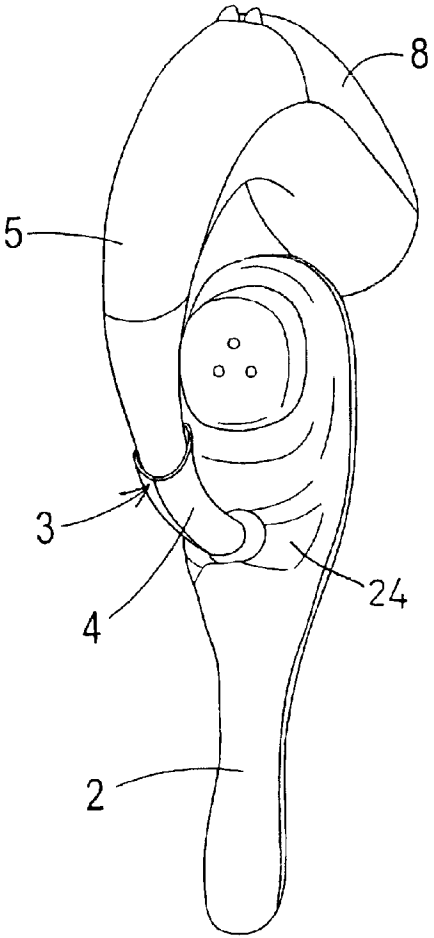
FIG. 3 is a rear perspective view of the earpiece.
Figure 4:
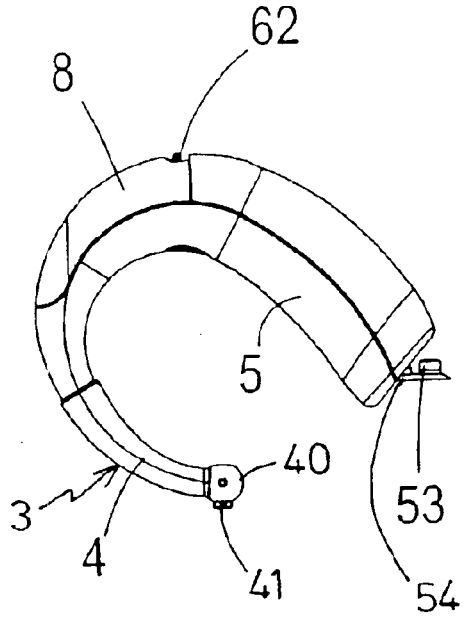
FIG. 4 is a side view of an arm and an arc of the earpiece.
Figure 5:
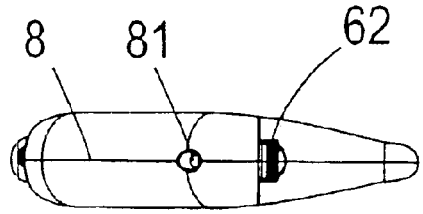
FIG. 5 is a top view of the arm of the earpiece.

A circuit board 20 is disposed in the housing 2 (FIG. 1), and includes one or more switches or buttons 21 provided thereon and extended outwardly through one or more corresponding orifices 11 of the cover 1, for controlling the circuit board 20 of the earpiece 1. The housing 2 includes a recess 24 formed in the rear portion thereof (FIG. 3).

An arm 3 includes such as two pieces or two halves 4 secured together by such as welding processes, or with fasteners (not shown), adhesive materials, or the like, and includes a ball 40 provided on one end thereof, and engaged into the recess 24 of the housing 2. The arm 3 may include one or more projections 41 extended from the ball 40 thereof and rotatably engaged into the housing 2.

An arc 5 includes one or more peripheral bulges 51 and/or one or more peripheral grooves 50 formed in one end thereof and defined between the bulges 51. The one end of the arc 5 may be engaged into the arm 3. The arm 3 includes one or more peripheral swellings 42 engaged into the peripheral grooves 50 of the arc 5, to rotatably secure the arc 5 to the arm 3.

The arc 5 includes a chamber 52 formed therein, a cap 8 is engageable onto the arc 5, for enclosing the chamber 52 of the arc 5, and includes an aperture 81 formed therein. A lid 53 is pivotally attached to the arc 5 with such as a live hinge 54, for allowing the lid 53 to be rotated relative to the arc 5, to enclose an opening 83 of the cap 8.

Figure 2:
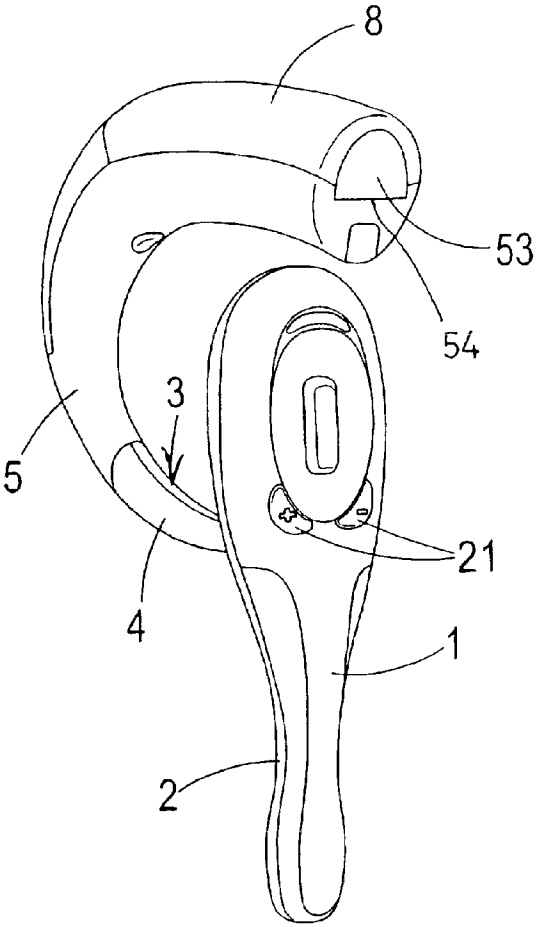
FIG. 2 is a front perspective view of the earpiece.

A casing 6 is to be disposed in the chamber 52 of the arc 5, and includes a latch 62 detachably secured to the arc 5, for detachably securing the casing 6 to the arc 5, and includes a hole 61 formed in one end thereof. The casing 6 includes a space 63 formed therein to receive one or more batteries 7 therein. The lid 53 may be rotated relative to the arc 5, to enclose or shield the hole 61 of the casing 6 (FIG. 2).

Figure 8:
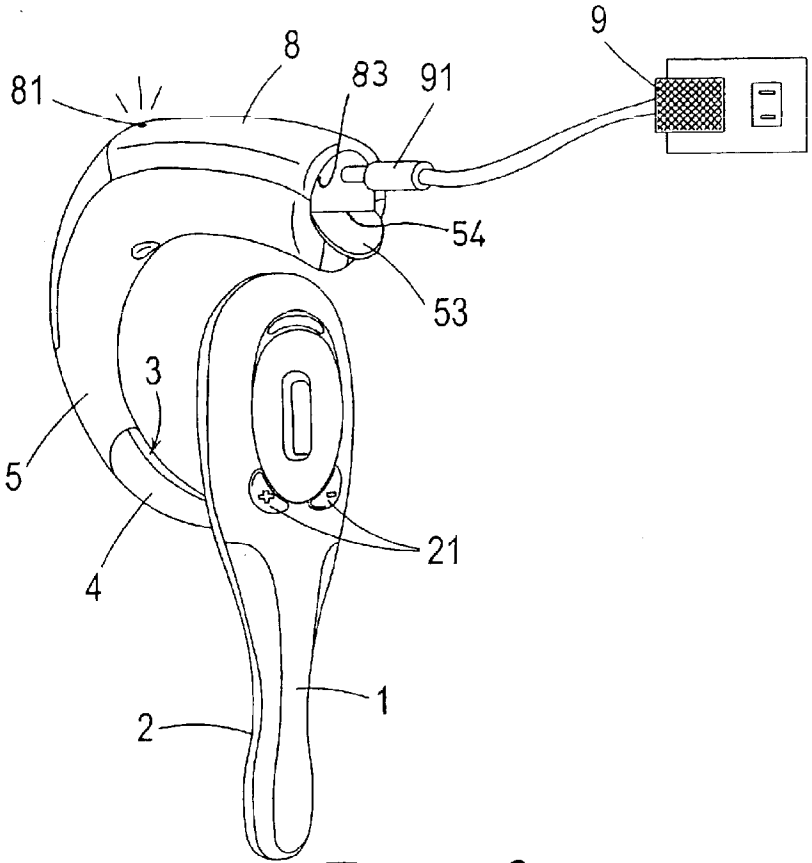
FIGS. 7, 8, 9 are perspective views illustrating the operation of the earpiece.
Figure 7:
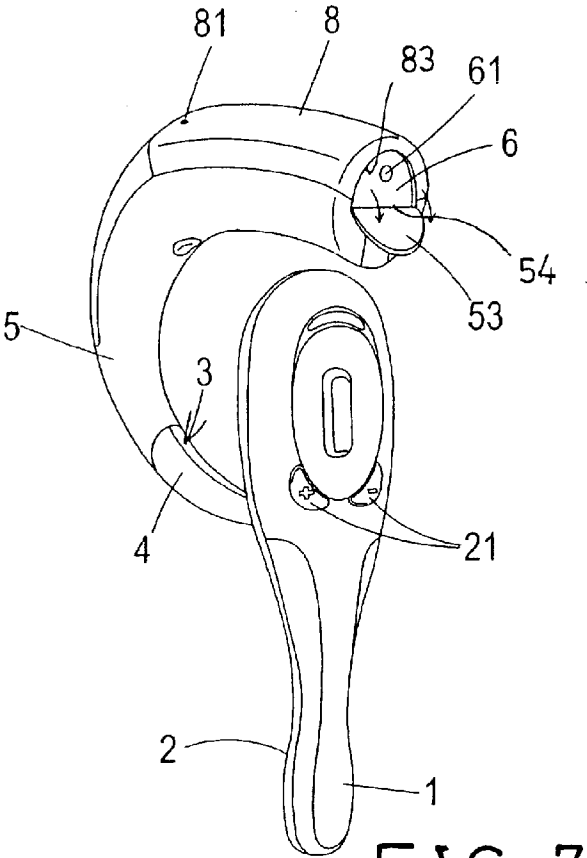
Figure 9:
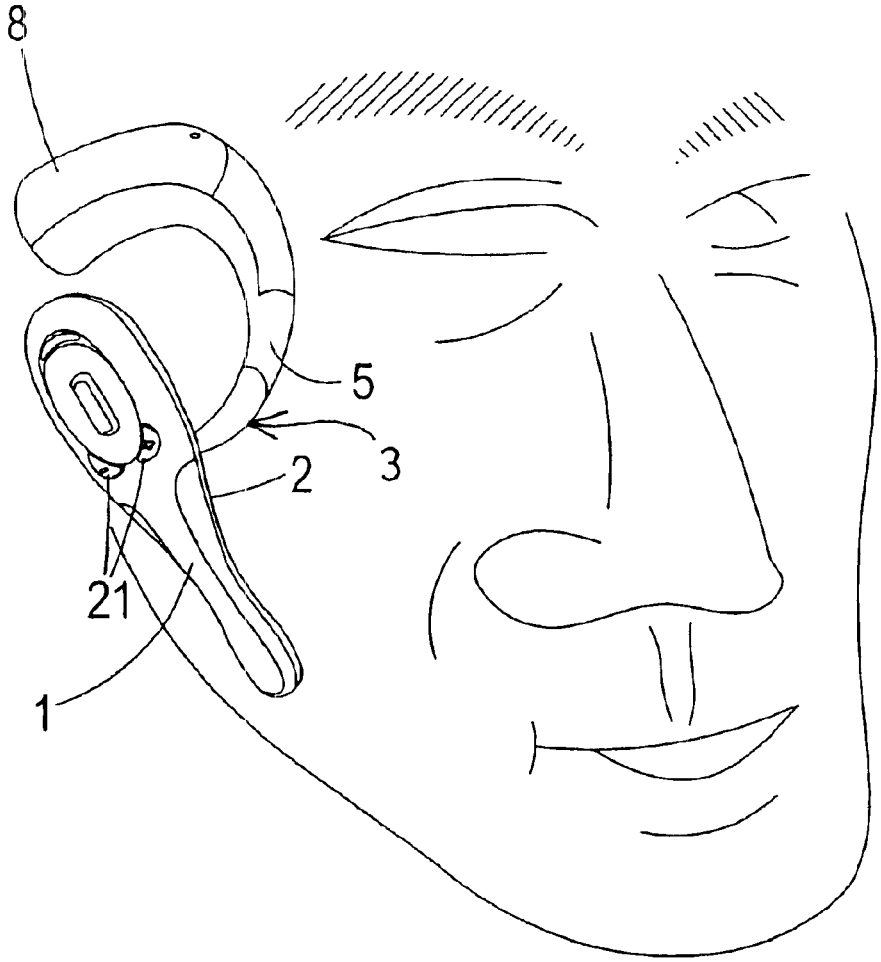

The battery 7 may include a light member 72 attached or coupled thereto and engaged through the aperture 81 of the cap 8, to indicate such as the charging operation of the battery 7. The battery 7 may further include a socket 71 attached or provided thereon and aligned with the hole 61 of the casing 6, for receiving a plug 91 of a charging device 9 (FIGS. 6, 8).

Figure 6:
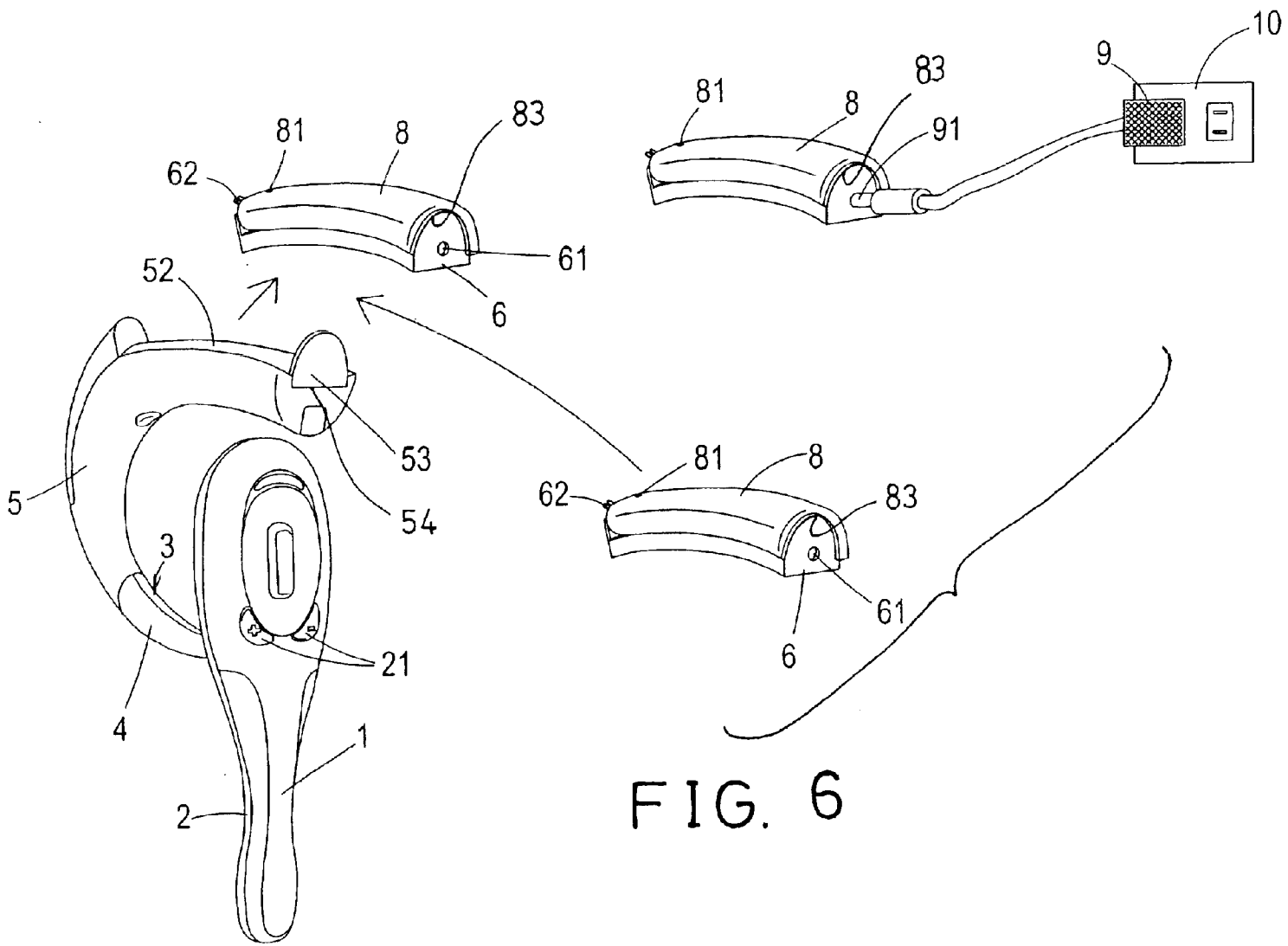
FIG. 6 is a partial exploded view illustrating the operation of the battery device of the earpiece.

In operation, as shown in FIG. 6, when the battery 7 is short of electric energy, the casing 6 and the battery 7 and the cap 8 may be simultaneously disengaged from the arc 5 by the latch 62, and the battery 7 may be easily and readily coupled to the electric power source 10 of such as the house families with the plug 91 of the charging device 9.

Another casing 6 and battery 7 and cap 8 may be attached onto the arc 5 to energize the earpiece while charging the battery 7 that is short of electric energy. The users are not required to wait until the battery 7 is fully charged.

Accordingly, the earpiece in accordance with the present invention includes a battery device that may be easily disengaged or detached from the earpiece for charging purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An earpiece comprising:

a housing, an arm including a first end having at least one projection extended therefrom and rotatably engaged into said housing, and said arm including a second end, an arc including a first end rotatably secured to said second end of said arm, and rotatable relative to said arm, and said arc including a chamber formed therein, a casing received in said chamber of said arc, and including a space formed therein, a battery received in said space of said casing, a cap engaged onto said casing, to retain said battery in said casing, and said casing including a latch detachably secured to said arc, to detachably secure said casing and said battery and said cap to said arc.

2. The earpiece as claimed in claim 1, wherein said housing includes a recess formed in said rear portion thereof, to rotatably receive said first end of said arm.

3. The earpiece as claimed in claim 1, wherein said first end of said arm includes a ball provided therein, and having said at least one projection extended from said ball.

4. The earpiece as claimed in claim 1, wherein said arc includes at least one peripheral groove formed in said first end thereof, and said arm includes at least one peripheral swelling extended therefrom and engaged into said at least one peripheral groove of said arc, to rotatably secure said arm to said arc.

5. The earpiece as claimed in claim 1, wherein said housing includes a cover attached thereon and having at least one orifice formed therein, said housing further includes a circuit board disposed in said housing, and having at least one button disposed thereon and extended through said at least one orifice of said cover.

6. The earpiece as claimed in claim 1, wherein said casing includes a hole formed therein, said battery includes a socket provided thereon and aligned with said hole of said casing.

7. The earpiece as claimed in claim 6 further comprising a charging device having a plug engaged through said hole of said casing and coupled to said socket of said battery.

8. The earpiece as claimed in claim 6, wherein said arc includes a pivotal lid attached thereto to enclose said hole of said casing.

9. The earpiece as claimed in claim 1, wherein said cap includes an aperture formed therein, said battery includes a light member attached thereto and engaged through said aperture of said cap.

10. The earpiece as claimed in claim 1, wherein said cap includes an opening formed therein, said arc includes a pivotal lid attached thereto to enclose said opening of said cap.

* * * * *